US005989675A

United States Patent [19]

Chen

[11] Patent Number: 5,989,675

[45] Date of Patent: Nov. 23, 1999

[54] CORED FORM SURFACE PATTERN STRUCTURE

[76] Inventor: Shou-Te Chen, No. 1, Alley 11-1, Lane 123, Chang-I 6 Street, Tai-Ping Hsiang, Taichung Hsien, Taiwan

[21] Appl. No.: 08/992,272

[22] Filed: Dec. 17, 1997

[51] Int. Cl.[6] ..... B44C 1/26; B32B 3/02

[52] U.S. Cl. ..... 428/67; 428/143; 428/157; 428/213; 428/188

[58] Field of Search ..... 428/156, 172, 428/187, 67, 31, 34, 143, 157, 213, 114, 38, 188

[56] References Cited

U.S. PATENT DOCUMENTS 4,339,489 7/1982 Barker et al. ..... 428/167

4,610,099 9/1986 Signori ..... 76/29

*Primary Examiner*—Donald Loney

*Attorney, Agent, or Firm*—Bacon & Thomas

[57] ABSTRACT

A cored form surface pattern structure includes a cored form having a first face plate and a second face plate, with the second face plate from the first plate separated by a suitable interval and a pattern located in the said first face plate. The said pattern can consist of characters, trademarks or graphics. The outline profile of the aforementioned pattern is a beveled edge of an appropriate angle, with the slant oriented from the lower surface of the pattern towards a central area of the upper surface such that the slanted outline of the pattern is positioned by the compressive and coating action of the cored form face plate and only the upper surface of the pattern is shown.

4 Claims, 3 Drawing Sheets

CORED FORM SURFACE PATTERN STRUCTURE

BACKGROUND OF THE INVENTION

1. Field of the Invention

The invention herein relates to a cored form surface pattern structure that is simple to fabricate and has enhanced pattern replacement functions and, furthermore, enables the pattern and the cored form surface to be of different colors.

2. Description of the Related Art

There are numerous typical cored form structures. For example, these include tool boxes, tool carrier boards and brief cases, etc.; such cored form structures can generally be characterized as having two surface layers, with air occupying the space in between the two surfaces. The practical function of these dual layers, taking the tool carrier board (1) shown in FIG. 1 as an example, is often to enable the forming of aesthetically appealing pattern (12) on the exterior section of the first face plate (11). Such patterns may occasionally include characters, trade marks or drawings and, as indicated in FIG. 2, the second face plate (13) is typically formed with a recess (14) of a specific shape at the interior section, which serves as a space for the insertion and fastening of a specifically shaped tool. Since the fabrication of these types of cored form structures often involves the utilization of a mold having a mold cavity with an identical exterior figured profile, after a molten cylindrical pellet of a plastic material is dropped into the mold cavity and subjected to air injection, the plastic pellet expands and is shaped against the walls of the mold cavity and, therefore, referring to the pattern (12) shown in both FIG. 1 and FIG. 2, since the pattern (12) relief on the first face plate (11) of the tool carrier board (1) cannot be formed unless the pattern relief is the same color as the tool carrier board (1), there is an overall lack of provisions for variation. Furthermore, since the forming of the pattern (12) involves the simultaneous forming of the pattern (12) casting details in the mold cavity of the cored form for the tool carrier board (1), the cored form for the said tool carrier board (1) only has the capability to form pattern (12) and, if another pattern is desired to be formed on the tool carrier board (1) utilizing the original cored form, the task would be impossible to achieve unless another mold was fabricated. Such a fabrication would also raise costs considerably.

SUMMARY OF THE INVENTION

The objective of the invention herein is to provide an improved cored form surface pattern structure that includes on the cored form a first face plate and a second face plate, an appropriate interval in between the two face plates, and a pattern on one of the face plates, wherein the pattern can consist of characters, trademarks or graphics. The outline of the pattern is beveled at the edge at an appropriate angle, with the direction of the slant oriented from the lower section of the pattern towards the central angle of the surface, such that the slanted outline of the pattern is positioned by the compressive and coating action of the cored form face plate, and only the surface of the pattern is shown.

DETAILED DESCRIPTION OF THE INVENTION

In the detailed description of the preferred embodiments of the invention herein, similar elements are indicated by the same reference numbers through the disclosure.

Figure 1:
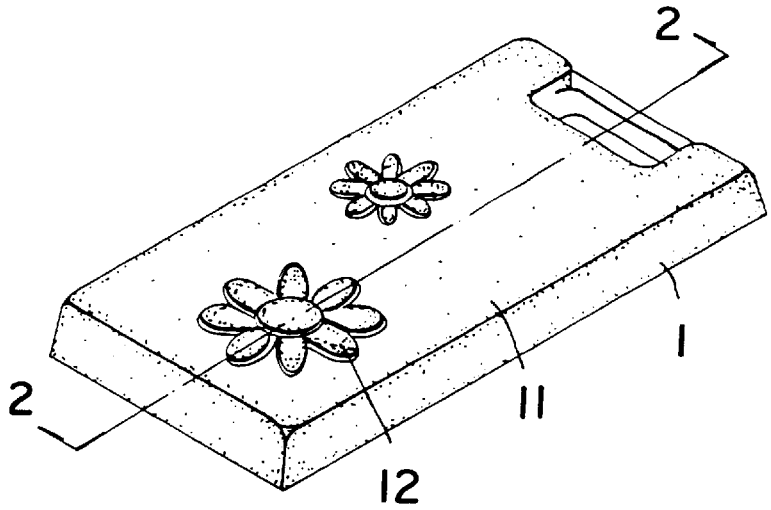
FIG. 1 (PRIOR ART)
FIG. 1 is an isometric drawing of a conventional cored form surface structure.
Figure 2:
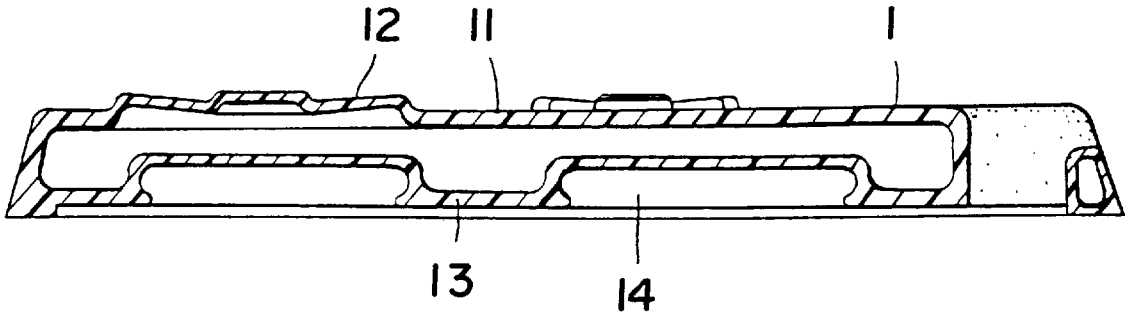
FIG. 2 (PRIOR ART)
FIG. 2 is a cross-sectional drawing of FIG. 1 from the perspective of line A—A.
Figure 3:
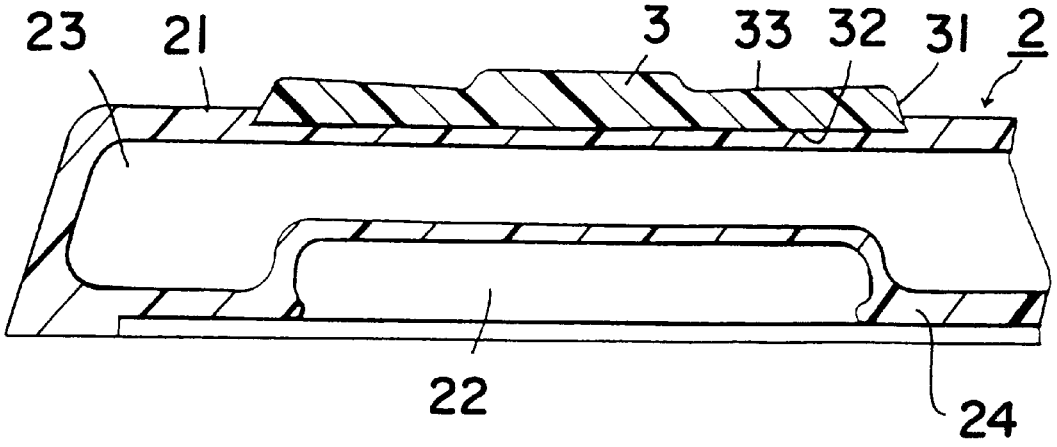
FIG. 3 is a cross-sectional drawing of the preferred embodiment of the invention herein.

Referring to FIG. 3, the cored form (2) of the tool carrier board is a concrete example of the preferred embodiments of the invention herein, wherein the cored form (2) structure of the tool carrier board is comprised of a first face plate (21) on which is placed an aesthetic pattern (3), with the pattern (3) composed of various characters, trademarks or graphics, and a second face plate (24) that is separated from the first face plate (21) by an appropriate interval to form a recess (22) of a specific shape which serves as a space for the insertion and fastening of a specifically shaped tool. The profile of the pattern (3) has an appropriately angled beveled edge (31) such that the slant of the bevel angle is oriented from the bottom surface (32) of the pattern (3) towards a central area of the upper surface (33), enabling the bottom section (32) of the pattern (3) to have a larger surface area than the surface (33). The profile of the beveled edge (31) can be either a total or a partial gradient. Following prefabrication, the pattern (3) is placed in the cored form (2) shaping mold of the said tool carrier board to enable the compression and coating of the pattern (3) for an appropriate period of time during the forming of the first face plate (21), and since the bottom section (32) of the pattern (3) has a larger surface area than the surface (33) in the process of slant formation, the bottom section (32) is subjected to a coating action that positions and affixes the pattern (3).

The design of the preferred embodiments of the invention herein enables the pattern (3) to be of a material quality and coloration different from that of the cored form (2) of the tool carrier board and, as a result, beautifies the underlying cored form (3) of the tool carrier board. Furthermore, when patterns (3) in a range of different shapes or colors are desired on the same cored form (2) of the tool carrier board, the embodiments of the invention herein have provisions for replaceable patterns (3) of different shape or color which precludes the necessity of fabricating new forming molds for the cored form (2) of the tool carrier board and, therefore, increases manufacturing flexibility and reduces production cost.

Figure 4:
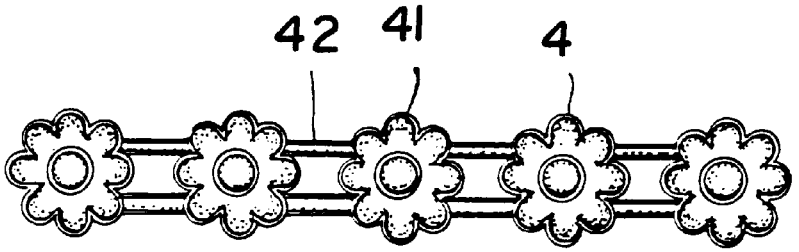
FIG. 4 is an orthographic drawing of another preferred embodiment of the pattern structure of the invention herein.
Figure 5:
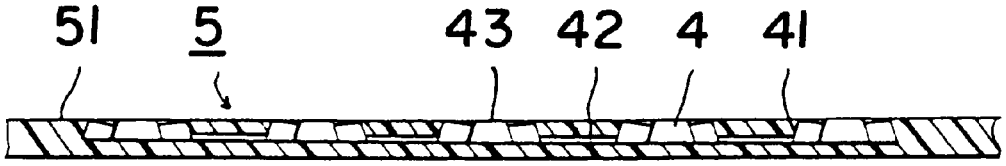
FIG. 5 is a partial cross-section drawing of another preferred embodiment of the invention herein (I).
Figure 6:
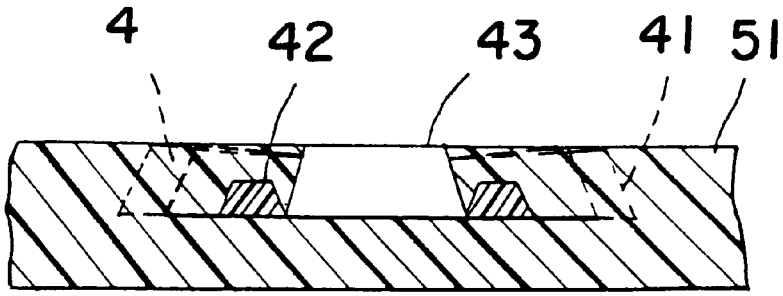
FIG. 6 is a partial cross-section drawing of another preferred embodiment of the invention herein (II).

In addition to the structural design of the single pattern (3) on the first face plate (21) of the tool carrier board cored form (2) in the preferred embodiments of the invention herein, when a continuous series involving a number of patterns is required, as indicated in the example indicated in FIG. 4, each of the patterns (4) has the same beveled edges (41) slanted at an appropriate degree to form the outline profile of the pattern (4) as in the foregoing description of aforementioned embodiments. Again, the profile of the beveled edges (41) can have a total or a partial gradient, and additionally have a connective strip (42) of an appropriate length in between each two patterns (4), the thickness of the connective strip (42) being smaller than that of the patterns (4). Referring to FIG. 5 and FIG. 6, when the first face plate

(51) of the cored form (5) is assembled, in addition to compressing and coating of the profile beveling of the pattern (4) on the first face plate (51), a connective strip (42) is also coated onto the first face plate (51) and is only shown on the upper surface (43) of each pattern (4).

The design provided by the preferred embodiments of the invention herein is not only simple in structure, but also accommodates the production of patterns of virtually any shape or form, including characters, drawings and trademarks, on the surface of the cored form as well as in colors that match or contrast with the surface color of the cored form. At the same time, when many differently shaped or colored patterns must be produced on the same cored form, the preferred embodiments of the invention herein allows for replaceable patterns of different shape and color, and does not require the fabrication of additional cored form molds, thereby enabling substitution during production and lower manufacturing costs.

While the invention herein has been described in relation to the most practical and preferred embodiments, the invention herein is not limited to the disclosed embodiments and includes the various configurations covered by the spirit and scope of the invention herein.

What is claimed is:

1. A cored form surface pattern structure, comprising:

a cored form having a first section that forms a first face plate and a second section that forms a second face plate separated from the first face plate; and a pattern member arranged to form a pattern and having upper and lower surfaces connected by a beveled edge extending around a perimeter of the pattern member, said beveled towards an upper surface of the pattern member to form an angled lower section of the pattern member, wherein the first face plate surrounds, coats, and compresses said angled lower section of the pattern member to secure the pattern member to the first face plate, leaving only the upper surface of the pattern member exposed so that said pattern is visible from outside the cored form pattern structure.

2. A cored form surface pattern structure as claimed in claim 1, wherein the pattern member is arranged to form a series of patterns.

3. A cored form surface pattern structure as claimed in claim 2, wherein said pattern member includes connective strips arranged to connect said patterns of said series of patterns.

4. A cored form surface pattern structure as claimed in claim 3, wherein a thickness of said connective strips is less than a thickness of portions of said pattern member arranged to form said patterns.

* * * * *